US006572338B2

(12) United States Patent
Janisse et al.

(10) Patent No.: US 6,572,338 B2
(45) Date of Patent: Jun. 3, 2003

(54) MODULAR AIR CIRCULATOR CONTROL

(75) Inventors: Jay R. Janisse, Clarkston, MI (US); Mark T. Janisse, St. Clair Beach (CA); Russell J. Tobin, St. Claire Beach (CA)

(73) Assignee: Dwight C. Janisse & Associates, Inc., Troy, MI (US)

( * ) Notice: Subject to any disclaimer, the term of this patent is extended or adjusted under 35 U.S.C. 154(b) by 11 days.

(21) Appl. No.: 09/894,369

(22) Filed: Jun. 27, 2001

(65) Prior Publication Data

US 2002/0016148 A1 Feb. 7, 2002

(51) Int. Cl.[7] ..... F04B 49/00

(52) U.S. Cl. ..... 417/12; 417/44.1; 62/231; 454/256; 318/445

(58) Field of Search ..... 417/12, 44.1, 53; 62/231; 454/256, 229, 239; 310/68 R, 71, 89, 101; 318/445, 452, 364, 446, 362, 778; 165/200; 236/46 R

(56) References Cited

U.S. PATENT DOCUMENTS

| | | | | |
|---|---|---|---|---|
| 4,035,668 A | | 7/1977 | Minami et al. | |
| 4,041,723 A | | 8/1977 | Weibel, Jr. et al. | |
| 4,209,995 A | | 7/1980 | Ferdelman | |
| 4,366,425 A | | 12/1982 | Shen | |
| 4,386,649 A | * | 6/1983 | Hines et al. | 165/12 |
| 4,515,538 A | * | 5/1985 | Shih | 417/572 |
| 4,785,198 A | | 11/1988 | Chin-Hsiang | |
| 4,856,078 A | | 8/1989 | Konopka | |
| 4,952,283 A | | 8/1990 | Besik | |
| 4,953,450 A | | 9/1990 | Remondino | |
| 5,041,825 A | | 8/1991 | Hart et al. | |
| 5,130,587 A | | 7/1992 | Janisse et al. | |
| 5,142,880 A | | 9/1992 | Bellis | |
| 5,187,472 A | | 2/1993 | Hart et al. | |
| 5,189,412 A | * | 2/1993 | Mehta et al. | 340/825.22 |
| 5,451,745 A | | 9/1995 | Goldberg et al. | |
| 5,528,014 A | | 6/1996 | Goldberg et al. | |
| 5,582,233 A | * | 12/1996 | Noto | 165/247 |
| 5,722,887 A | | 3/1998 | Wolfson et al. | |
| 5,809,793 A | | 9/1998 | Shutt et al. | |
| 6,126,079 A | | 10/2000 | Shoemaker | |
| 6,205,801 B1 | * | 3/2001 | Riglos et al. | 62/231 |
| D440,883 S | * | 4/2001 | Wilson, Jr. | D10/2 |

FOREIGN PATENT DOCUMENTS

| | | | |
|---|---|---|---|
| DE | 3908492 A1 | * | 9/1989 |
| JP | 61-66029 | * | 4/1986 |

* cited by examiner

*Primary Examiner*—Charles G. Freay
*Assistant Examiner*—Han L. Liu
(74) *Attorney, Agent, or Firm*—Carlson, Gaskey & Olds

(57) ABSTRACT

The modular timer for an air circulator comprises a timer for energizing an air circulator motor for a predetermined amount of time. A first connector connects the timer to an air circulator motor while a second connector connects the timer to a power switch. A selection switch controls the timer setting of the timer such that the time period corresponds to at least one time period of a work shift. A housing limits access to the selection switch and protects it.

20 Claims, 2 Drawing Sheets

MODULAR AIR CIRCULATOR CONTROL

BACKGROUND OF THE INVENTION

This invention relates to an apparatus for controlling an individual industrial air circulator.

Air circulators are frequently used in manufacturing settings to provide a relatively inexpensive means of evaporative cooling for workers. In such settings, manufacturers operate a great number of these air circulators at a time during a work shift. These air circulators are each controlled by the individual worker, who switches the air circulator "on" and "off" or changes the fan speed. Often an individual worker may forget to turn off his air circulator at the end of a work period. When a large number of workers consistently fail to switch off their air circulators, the electrical cost of operating these air circulators increases as does the wear and tear on each unit.

Ventilation fans for applications other than such work environments, have been provided with timer controls that turn ventilation fans, such as attic ventilator fans, "on" and "off" on a predetermined cycle. Such fans are typically provided with a timing control positioned outwardly of the fan and are usually accessible to an owner of the residence including the fan. The ventilator fan may thus be timed to a particular period of "on"/"off" cycles. Such controls have never been provided in a factory setting for industrial air circulators. Also, the prior art controls may not fully address the problems mentioned above. Moreover, the prior art of ventilator fan timing controls has not been utilized in conjunction with the workday, but rather with other ventilation or cooling needs.

A need therefore exists for a relatively inexpensive device that automatically turns off the operation of the air circulator approximately following the end of a work period.

SUMMARY OF THE INVENTION

One aspect of the invention comprises a modular timer for an industrial air circulator. The timer serves to energize a motor of the air circulator for a predetermined amount of time. The timer has a first conductor, such as a wire, with a first connector and a second conductor with a second connector. The first connector operatively connects the air circulator motor to the timer while the second connector operatively connects the timer to a switch. One of the connectors may be a removable connector to allow for rapid removable installation of the timer into an air circulator unit, either during the initial manufacturing process or as a retrofit to an already constructed air circulator unit already in service.

Typically, the timer is designed such that the time of activation of the air circulator is tied to an average work day shift or period and includes a selection switch that controls the amount of time the timer energizes the air circulator motor. Thus, times of four hours, eight hours, ten hours, twelve hours, etc., could be utilized. Further, it may be desirable to have a time period that is somewhat less than the average work day, in that the workers may not turn the air circulator on until later in the work day when the ambient temperature increases. Thus, a time of four, five, or six hours may also be preferred.

The timer will commence to run upon actuation of the power switch. In this way, the timer runs when the worker arrives for his shift and turns the air circulator switch on, rather than by clock setting. Moreover, the timer may be designed such that each actuation of a power switch will reset the timer. By providing this resetting feature, the invention becomes particularly useful for timing the shutoff more closely to the end of a work shift. As an example, if the air circulator is not turned on until the middle of the day, then the air circulator will run for a period of time at the end of the day. However, if a shorter time period (i.e., four hours) is provided, then when the air circulator shuts off after four hours if the worker is still on shift, he can simply reset the timer by actuating the air circulator switch.

In a further beneficial aspect of this invention, the timer is not accessible from outside of the air circulator. In one well-known type of air circulator, a motor housing is attached to the air circulator body such that access to the interior of the motor and control is provided for maintenance. However, in the factory setting the entire air circulator assembly is often mounted remote from the workers. The air circulator may be mounted on the ceiling, or on a relatively high stand. In either situation, by incorporating the timer into the air circulator motor housing, the timer is kept remote from the workers. In this fashion it is less likely that the workers will change the air circulator control from the desired time set by the maintenance/electrical engineers for the assembly line. Also, theft or damage of the timer is eliminated when mounted in this fashion.

These and other features of the present invention can be best understood from the following specification and drawings, the following of which is a brief description.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
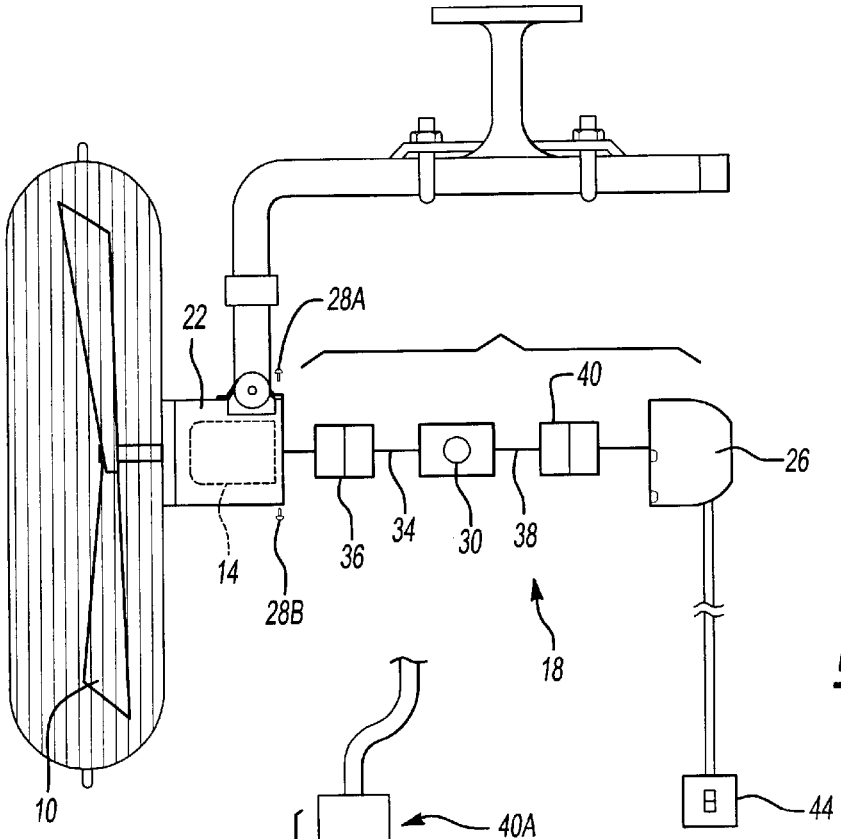
FIG. 1 shows an embodiment of the invention, including air circulator and timer.

FIG. 1 illustrates an embodiment of the invention. The air circulator assembly comprises air circulator 10 operatively connected to air circulator motor 14. Timer 30 is shown with housing 18, which may have at least first portion 22 and second portion 26. This type of motor housing is known and described, as example, in U.S. Pat. No. 5,130,587. First portion 22 may be selectively connected to second portion 26 to allow their mutual attachment or detachment by means known in the art. As can be appreciated in FIGS. 1 and 3, when the second portion 26 is secured to the first portion 22, the timer 30 will be generally enclosed. Screws 28A and 28B, or other means known, may be used to fasten first portion 22 to second portion 26 in such a way as to limit accessibility of timer 30, thereby inhibiting tampering with timer 30 and protecting it from damage or theft.

As further illustrated in FIG. 1, first conductor 34 with first connector 36 operatively connects timer 30 to motor 14. Second conductor 38 with second connector 40 operatively connects timer 30 to power switch 44. A power switch 44 selectively connects electrical power to the motor 14. This is known as a "drop switch" arrangement such that the fan 10 may be mounted high in an industrial facility with the switch hanging lower and by the workers. The details of this switch are set forth in U.S. Pat. No. 5,130,587, as an example. Moreover, within the context of this application, the term "power switch" can refer not only to this type switch but also to a pull chain type switch such as disclosed in U.S. Pat. No. 5,130,587, and in addition other types of switches. That is, the detail of the switch forms no portion of this invention.

Figure 2:
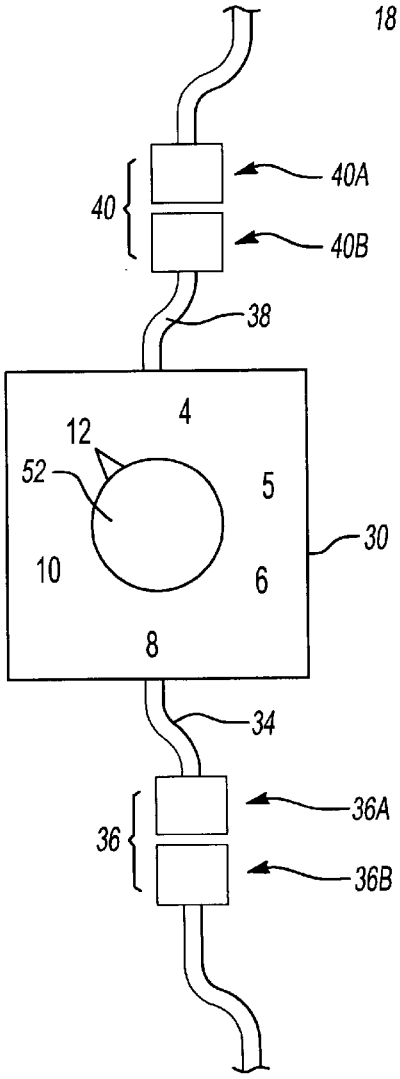
FIG. 2 shows an alternate view of the timer of FIG. 1.

FIG. 2 shows a close up perspective of the timer 30 of FIG. 1. Timer 30 has first conductor 34 and first connector 36 and second connector 40 and second conductor 38. The modular design of timer 30 and corresponding conductors 34 and 38 and connectors 36 and 40 contribute greatly to the ease of installation of the modular timer 30 into air circulator assemblies during the manufacture process or as a retrofit into existing air circulator assemblies.

The timer 30 is preferably incorporated as a modular unit between the connectors 36 and 40, which permit quick attachment and are preferably removable connectors allowing for quick disconnection. Accordingly, connector 40 may comprise first connector portion 40A that quickly attaches to second connector portion 40B while connector 36 may comprise first connector portion 36A that quickly attaches to second connector portion 36B. These removable connectors are commonly available. In this way, timer 30 maybe quickly installed or removed from within housing 18.

In addition, as further seen in FIG. 2, while timer 30 may be as generally known in the art, and as is commonly available, timer has a unique selection control knob 52 to selectively choose a plurality of hour times more closely associated with a work shift then has been the case in the prior art. Here, a four-hour, five-hour, six-hour, eight-hour, ten-hour, and twelve-hour time period is shown on timer 30. Other time periods may be predetermined and employed to satisfy the particular needs of the customer.

Another aspect of this invention is the provision of a work environment where a plurality of air circulators are provided that are under the control of individual "on"/"off" switches 44 available to each worker. Each of the air circulators includes a timer such that the air circulator, once started, is turned off after a period of time that is selected to coincide with the work schedule. Upon actuation of switch 44, timer 30 begins to run for a predetermined amount of time, which relates to the time period of a work shift. Timer 30 energizes the air circulator motor 14 for this time period. Following this time period, power is cutoff to air circulator motor 14 by timer 30 even though power switch 44 is left actuated. In this way, power is cutoff automatically without further effort by a worker. Timer 30 may be reset each time power switch 44 is actuated. In this way, without further actuation of power switch 44, air circulator motor 14 and air circulator 10 operates only for the predetermined time period corresponding to the selected work shift. Generally, the prior art which incorporates timers has the timer function in both an "on" and "off" function. That is, the timer will turn the air circulator "on" and "off" after a predetermined period of time. This invention incorporates a timer that turns the air circulator "off" a predetermined period of time after it is has been initially turned "on". As such, it is more applicable to the work environment.

Figure 3:
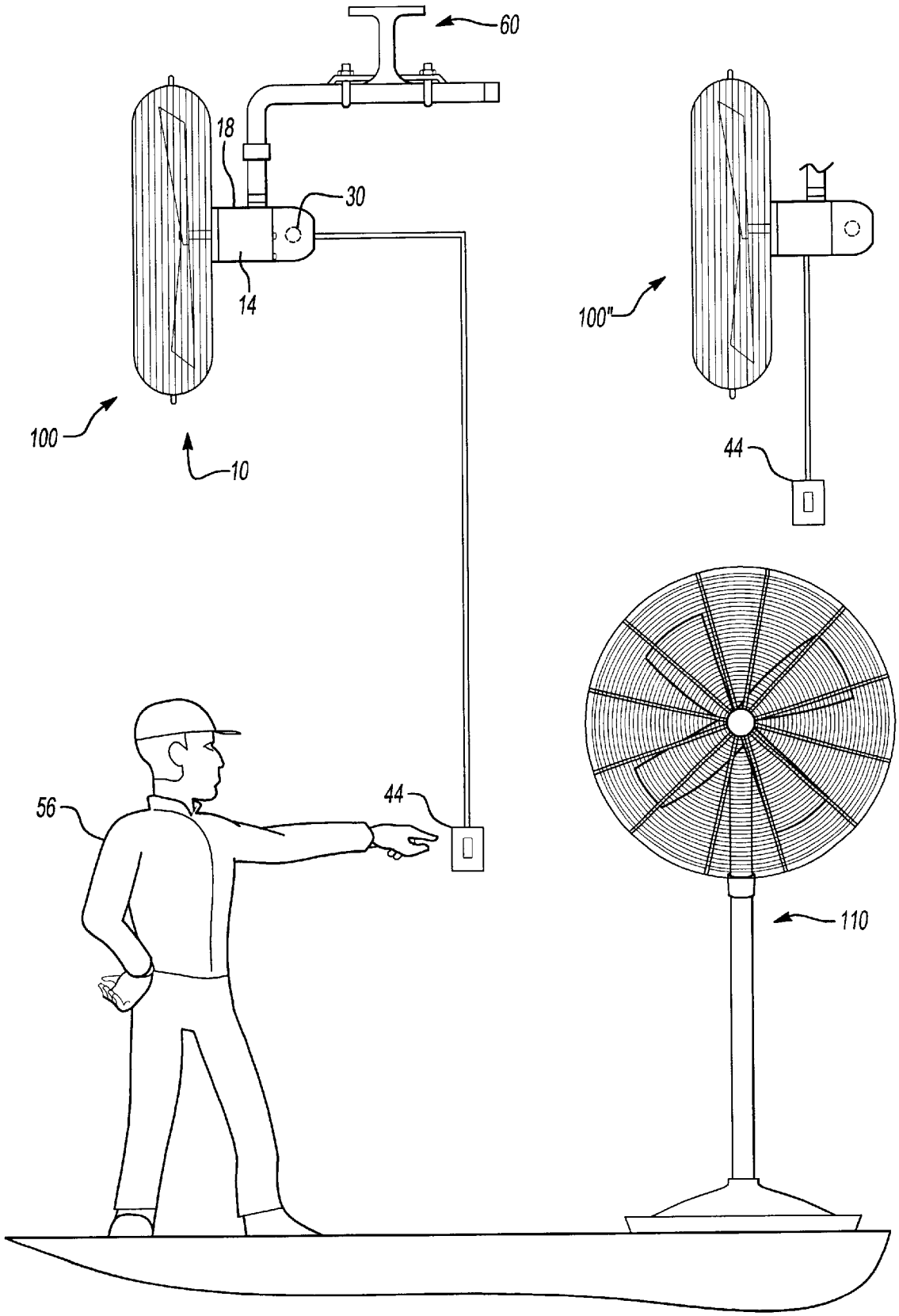
FIG. 3 shows the air circulator and timer of FIG. 1 and 2 in a work environment.

FIG. 3 illustrates the embodiments of FIGS. 1 and 2 in a work environment. Shown are air circulator 10, air circulator motor 14, housing 18, and timer 30. Operator 56 activates timer 30 by actuating power switch 44 operatively connected to a power source. Air circulator 10 and air circulator motor 14 continue to operate until timer 30 runs out. As shown, housing 18 is closed, limiting access to timer 30 and unauthorized alteration of the amount of time timer 30 operates. As mentioned above, simple screws 28A and 28B may serve as sufficient deterrence to tampering. Other means known may be used. Moreover, the air circulator and consequently timer 30 are placed on an overhead I-beam 60 or other difficult to reach locations may further serve to limit access to timer 30, thereby better meeting the needs of the work environment.

Without such tampering, air circulator 10 and air circulator motor 14 automatically stop after the predetermined time period, unless power switch 44 is again actuated. Because the predetermined time period may correspond or relate to a work shift, operator 56 typically actuates power switch 44 at the commencement of his work shift. Air circulator 10 and air circulator motor 14 turn off at the end of his shift but may be started again by the next operator at the commencement of the next work shift. Thus, air circulator 10 and air circulator motor 14 are generally limited in operation to the time period of a work shift.

As shown in FIG. 3, a number of other air circulators 100 are positioned about the work area. Each of the air circulators is provided with its own switch 44. Typically, each air circulator and switch is provided adjacent an area where a worker or workers spends their work day. The FIG. 3 environment shows fans 100 mounted adjacent the ceiling, but also fan 110 which can be mounted on a stand. Such fans are also utilized within the industrial environments which are the subject of this invention.

Further, while separate switches 44 are shown for each of the separate fans 100 and 110, it should also be understood that a single master switch can be utilized. In such a situation, the individual timers will still be associated preferably with each fan.

The aforementioned description is exemplary rather then limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A modular timer for an air circulator comprising:

a timer for energizing an air circulator motor for a predetermined amount of time;

a first removable connector, for operatively and removably connecting said timer to an electric air circulator motor;

a second removable connector, for operatively and removably connecting said timer to a power switch; and a selection control in communication with said timer, selectively controlling said predetermined amount of time wherein said predetermined amount of time relates to at least one time period of a work shift.

2. The modular timer of claim 1 wherein said timer is reset by actuation of the power switch.

3. The modular timer of claim 1 wherein said timer commences upon actuation of said power switch.

4. The modular timer of claim 1 wherein said at least one time period of a work shift comprise a plurality of hourly time periods of a work shift.

5. An air circulator assembly comprising:

an air circulator operatively connected to an air circulator motor, a housing attached to said air circulator motor;

a timer for energizing said air circulator motor for a predetermined amount of time;

a first connector, operatively connecting said timer to said air circulator motor;

a second connector, operatively connecting said timer to a power switch; and said timer running said predetermined period of time upon actuation of said power switch, said power switch being accessible for actuation from outside said housing and said timer being inside said housing and inaccessible from outside said housing.

6. The air circulator assembly of claim 5, wherein said timer is reset by actuation of said power switch.

7. The air circulator assembly of claim 5 wherein said at least one time period of a work shift comprise a plurality of hourly time periods of a work shift.

8. The air circulator assembly of claim 5, wherein said housing is two part housing.

9. The air circulator assembly of claim 5, wherein said timer includes a control to allow selection of various predetermined time periods, said control being concealed within said housing.

10. The air circulator assembly of claim 5, wherein said timer is reset by actuation of the power switch.

11. The air circulator assembly of claim 5, wherein said switch is mounted remotely from said housing.

12. The air circulator assembly of claim 11, wherein said switch is mounted on a drop cord extending downwardly from said housing, such that said switch is accessible to a worker in a work environment.

13. A work environment comprising:

a plurality of air circulators each including an air circulator motor and a power switch, positioned adjacent to a work area to be accessible to a worker and control of said plurality of fans; and a timer associated with each said air circulator motors to run said air circulator motor for a predetermined period of time selected to relate to a work shift, a housing attached to said air circulator motor, said power switch being accessible for actuation from outside said housing and said timer being inside said housing and inaccessible from outside said housing.

14. A work environment as recited in claim 13, wherein said timer is reset by actuation of said power switch.

15. A work environment as recited in claim 13, wherein said timer includes a control to allow selection of various predetermined time periods, said selection control being concealed within said housing.

16. A work environment as recited in claim 13, wherein there is a separate power switch for each of said plurality of air circulators.

17. A work environment as recited in claim 13, wherein said switch is mounted remotely from said housing.

18. A work environment as recited in claim 17, wherein said switch is mounted on a drop cord extending downwardly from said housing, such that said switch is accessible to a worker in a work environment.

19. An air circulator assembly comprising:

an air circulator operatively connected to an air circulator motor, a housing attached to said air circulator motor;

a timer for energizing said air circulator motor for a predetermined amount of time;

a first connector, operatively connecting said timer to said air circulator motor;

a second connector, operatively connecting said timer to a power switch; and said timer being removably connected to said air circulator motor and said timer being removably connected to said power switch by said first and second connectors, with said first and second connectors being removable, and said first and second connectors and said timer all being received within said housing.

20. A work environment comprising:

a plurality of air circulators each including an air circulator motor, an attached housing and a power switch, positioned adjacent to a work area to be accessible to a worker and control of said plurality of fans; and said timer being removably connected to said air circulator motor and said timer being removably connected to said power switch by said first and second connectors, with said first and second connectors being removable, and said first and second connectors and said timer all being received within said housing.

* * * * *